United States Patent [19]

Chang

[11] Patent Number: 4,556,392

[45] Date of Patent: Dec. 3, 1985

[54] BUBBLING SELF-PROPELLED TOY

[76] Inventor: Nelson S. Chang, 5, Lane 41, Lo Yang St., Taipei, Taiwan

[21] Appl. No.: 633,946

[22] Filed: Jul. 24, 1984

[51] Int. Cl.[4] ..... A63H 33/28

[52] U.S. Cl. ..... 446/16; 446/397; 446/437

[58] Field of Search ..... 46/485, 484, 297, 15, 46/16, 17, 18, 19, 20, 21

[56] References Cited

U.S. PATENT DOCUMENTS

| | | | |
|---|---|---|---|
| 2,225,702 | 12/1940 | Lyon, Jr. | 446/15 |
| 2,412,732 | 12/1946 | Holman | 446/16 X |
| 2,547,825 | 4/1951 | King | 446/16 |
| 2,734,311 | 2/1956 | Christopher | 446/485 X |
| 2,974,438 | 3/1961 | Hopkins | 446/16 |
| 3,021,639 | 2/1962 | Allen et al. | 446/18 |
| 3,100,947 | 8/1963 | Hellman | 446/16 |
| 3,228,136 | 1/1966 | Rouse | 446/16 |
| 3,913,260 | 10/1975 | Corbett | 446/16 |
| 4,044,496 | 8/1977 | Jernstrom | 446/16 |
| 4,133,138 | 1/1979 | Coons | 446/16 |
| 4,282,680 | 8/1981 | Zaruba | 446/485 X |
| 4,423,565 | 1/1984 | Bart | 446/16 |

FOREIGN PATENT DOCUMENTS

| | | | |
|---|---|---|---|
| 487368 | 10/1952 | Canada | 446/18 |

*Primary Examiner*—Robert E. Bagwill
*Assistant Examiner*—D. Neal Muir
*Attorney, Agent, or Firm*—Harding, Earley, Follmer & Frailey

[57] ABSTRACT

This invention relates to a self-driven bubbling toy, in the form of a bubbling octopus. It comprises a blowing means to produce an air jet and a delivering means to deliver an amount of frothing liquid from a reservoir to the route of said jet to blow it into bubbles, thereby increasing the amusement of the toy. Various sound and light effects can be applied to this toy.

4 Claims, 4 Drawing Figures

BUBBLING SELF-PROPELLED TOY

This invention relates to a self-propelled bubbling toy, in the form of an octopus, which can automatically draw a frothing water and blow bubbles. and meanwhile give sound and light effect.

This invention will be better understood when read in connection with the accompanying drawing, in which:

DETAILED DESCRIPTION OF PREFERRED EMBODIMENT

Figure 1:
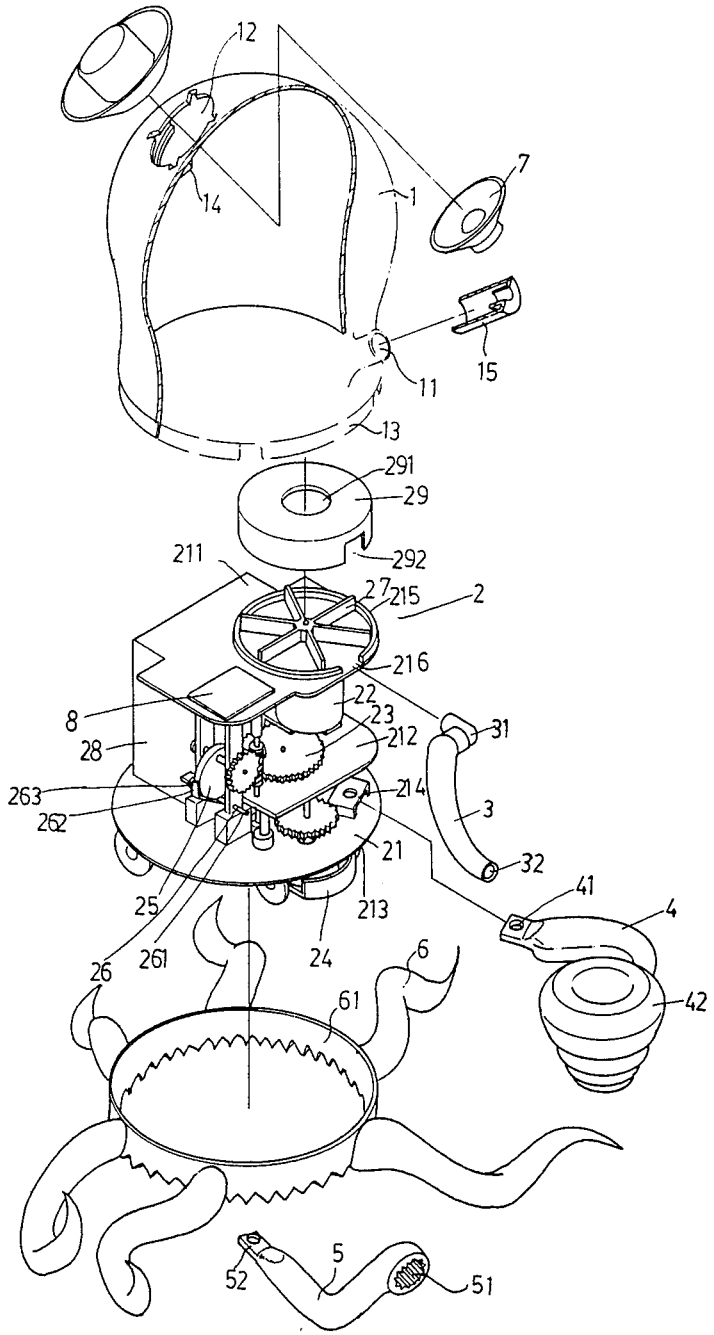
FIG. 1 is a an exploded view of this invention.

With reference to FIG. 1, this invention comprises a housing (1), chassis (2), tube (3), stop arm (4), rocking arm (5), tentacles (6), speaker (7), IC (8) etc. The housing (1) is in the form of an octopus' head, on which is a nostril (11), to which a sleeve (15) can be connected to elongate the length of air path. A hole (12) is provided at the top of the housing (1). Inside the rim of the hole there is provided securing means (14). The lower margin of housing (1) forms a flange (13) Chassis (2) comprises shelf (21), motor (22), transmission gears (23), rotary seat (24), cam (25), rocking rod (26), fan (27), battery seat (28), cover (29) etc. Shelf (21) is subdivided into upper stage (211), middle stage (212) and lower stage (213). Upper stage (211) is provided with a raiser (215) in which fan (27) is positioned. The incompleteness of raiser (215) provides an air outlet (216). The space between upper stage (211) and middle stage receives the motor (22), transmission gears (23), cam (25), rocking rod (26) etc. A positioning means (214) is provided on lower stage (213) to fix stop arm (4). Rotary seat (24) is mounted beneath lower stage (213). The motor is a bishaft motor. One end of its shaft is connected to the fan (27), and the other end is in mechanical connection with the transmission gears (23). The transmission gears (23) serve to reduce the speed and transmit the power to the rotary seat (24) and cam (25). The rotary seat (24) is freely rotatable about its own axis. It serves to change the advancing direction when the octopus touches an obstacle. When cam (25) is turned, the rocking rod (26) is pressed. One end (261) of rocking rod (26) is flat and fixed. A pressing reed (262) is provided at the periphery of cam (25). A spring (263) is provided for resumption purpose. Battery seat (28) is located at the rear side of the chassis (2) and is in electrical connection with the integrated circuit (8) on the upper stage (211), so as to energize the speaker (7) connected to the IC (8) and the LED's (not shown) which can be provided on the housing, to give a combined sound and light effect. Cover (29) can be sungly fitted to the raiser (215) to close the entire fan. A central hole (291) is provided in the flat face of cover, and a notch (292) is provided at the lower rim thereof, to respectively define the air inlet and outlet when fan (27) turns. One end (31) of tube (3) is inserted into the air outlet hole defined by the notch (292) and the incompleteness (216), while the other end (32) is inserted into the nostril (11). One end (41) of stop arm (4) is fixed. The other end enlarges to form the reservoir (42) for frothing liquid. One end (52) of rocking arm (5) is fixed. Its another end

(51) is internally toothed. Tentacles 16 are secured to a ring (61), which is in turn, fastened to the lower margin (13) of housing (1).

Figure 2:
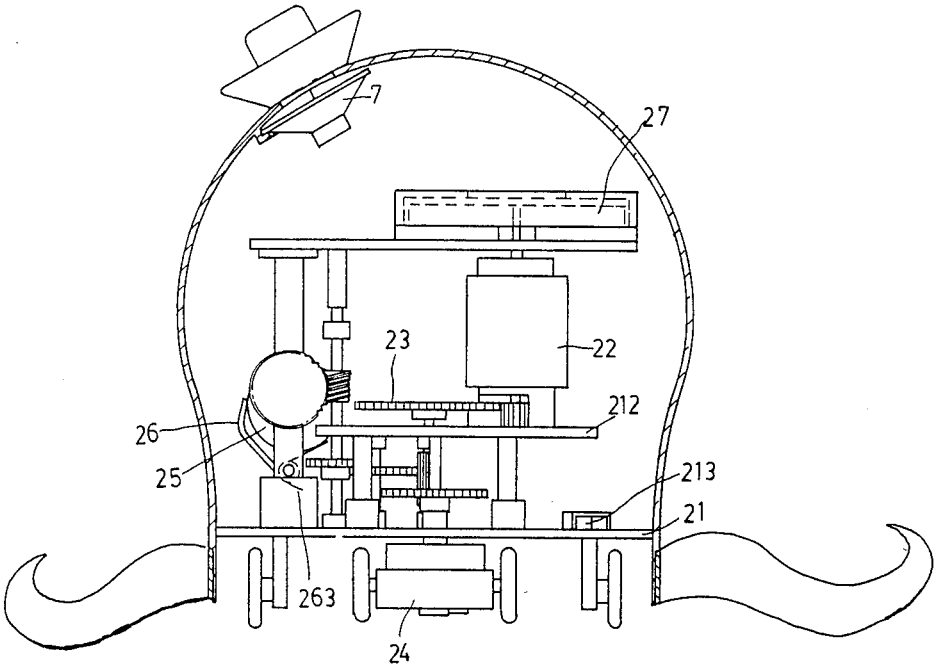
FIG. 2 is a sectional view of this invention.

In assemblage (also refer to FIG. 2), the fan (27) is placed in the raiser (215) and penetrated by the shaft of motor (22). Then cover (29) is fitted to the raiser (215). Transmission gears are placed between middle stage (212) and upper stage (211), cam (25) and rocking rod (26) are placed at one side. Rotary seat (24) is placed beneath the lower stage (213). Then speaker (7) is fitted in the securing means (14) in the hole (12). The hat is fitted into the hole (12). The sleeve (15) is fitted into the nostril (11). Then stop arm (4) is inserted from outside of the housing (1) to fix the end (41) to stop arm (4) to the positioning means (214) on lower stage (213). Then rocking arm (5) is inserted into the housing and connected to rocking arm (26). One end (31) of the tube (3) is inserted into the air outlet hole defined by the notch (292) and the incompleteness (216). Its other end (32) is inserted into the nostril (11) of the housing. Then the housing is fitted in place, and its lower margin (13) is nested in the ring (61), thus finishing the assemblage of this toy. It is noteworthy that according to a feature of this invention, the bishaft motor is so supported that its shaft is vertically mounted. The fan is directly mounted to the upper end of the shaft, so that its propeller rotates in a substantially horizontal plane. Such design is highly advantageous, since the circulating area of the fan coincides with the circular cross-section of the bulb-shaped housing (1) so that the resulting construction is very compact.

Figure 3:
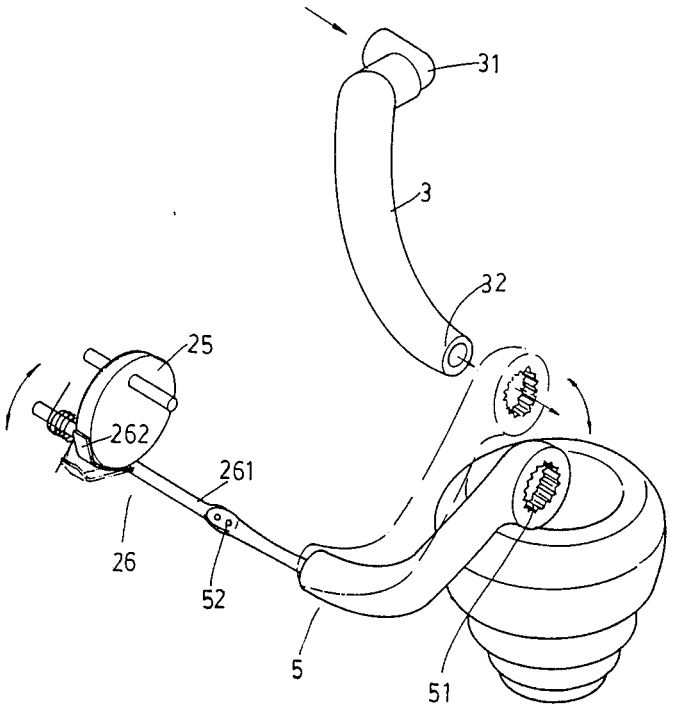
FIG. 3 is a schematic representation showing the movement of this invention.
Figure 4:
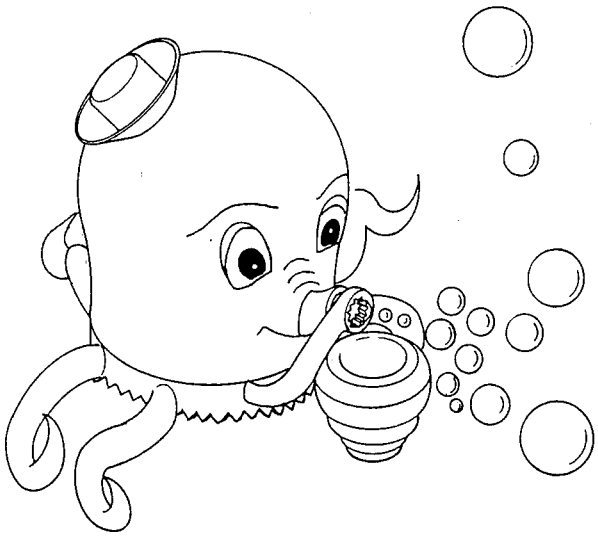
FIG. 4 is the external appearance of this invention.

When the motor (22) runs, both the fan (27) and transmission gears (23) are driven. The movement of the motor is transmitted and decelerated by the transmission gears (23) to drive rotary seat (24) and cam (25). The cam in turn rocks reed (262) to cause the rocking rod (26) to oscillate (FIG. 3), so that the rocking arm (5) may swing up and down. When the rocking arm (5) swings to its lowest point, it reaches into the reservoir (42) in which a frothing liquid is stored, and when it swings to its highest point, it reaches the vicinity of the nostril (11). Accordingly the frothing liquid is delivered in each cycle from the reservoir to the nostril and blown into bubbles, as seen in FIG. 4. This imparts to the octopus a realistic sense. Various sound and light effects can be applied, such as music, laughter, blinking eyes, to add to its amusement.

I claim:

1. A self-driven bubbling toy octopus, comprising:

(a) a chassis;

(b) a hollow housing in the form of an octopus' head mounted on said chassis;

(c) said housing having a lower margin from which a plurality of tenacles extend outwardly and a nostril providing an outlet for an air jet;

(d) a bishaft motor disposed internally of said housing, said motor having a rotatable shaft;

(e) reservoir means for containment of a frothing liquid;

(f) air blower means disposed internally of said housing to produce an air jet;

(g) air conduit means connecting the air blower means to the nostril to guide the air jet to said nostril;

(h) movable froth delivery means connected to the chassis and operative to deliver an amount of frothing liquid to the vicinity of the nostril to be blown into bubbles by the air jet produced by the air blower means; and (i) drive means connecting the bishaft motor to the air blower means and to the movable froth delivery means.

2. The toy according to claim 1, wherein:

(a) the bishaft motor is provided with a vertically extending shaft, said shaft having an upper end and a lower end;

(b) the air blower means comprises a rotatable fan connected to one end of the shaft said fan being located in a substantially horizontal plane;

(c) rotary driving means connected to the chassis to impart movement to the toy; and (d) mechanical drive means connecting the other end of the shaft of the bishaft motor to the rotary driving means for the chassis and to the movable froth delivery means.

3. The toy according to claim 2, wherein the mechanical drive means includes:

(a) gear means connecting the shaft of the bishaft motor to the chassis rotary driving means to impart rotational drive to said means and (b) cam means connected to the shaft of the bishaft motor to impart oscillatory movement to the froth delivery means for periodically delivering frothing liquid to the vicinity of the nostril.

4. The toy according to claim 5, further comprising means to produce sound and light efffect.

* * * * *